US006648691B2

(12) United States Patent
Henrici et al.

(10) Patent No.: US 6,648,691 B2
(45) Date of Patent: Nov. 18, 2003

(54) HIGH-VOLTAGE LAMPHOLDER WITH QUICK-CONNECT CONTACTS

(75) Inventors: Dieter Henrici, Arnsberg (DE); Herbert Beleke, Arnsberg (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 10/289,446

(22) Filed: Nov. 6, 2002

(65) Prior Publication Data

US 2003/0119363 A1 Jun. 26, 2003

(30) Foreign Application Priority Data

Dec. 21, 2001 (DE) ..... 101 63 055

(51) Int. Cl.[7] ..... H01K 1/00; F21S 3/00
(52) U.S. Cl. ..... 439/619; 362/260
(58) Field of Search ..... 439/619, 612, 439/617, 414, 220, 280, 336; 362/260, 226, 220

(56) References Cited

U.S. PATENT DOCUMENTS 4,768,966 A * 9/1988 Doherty ..... 439/137
5,758,952 A * 6/1998 Getselis et al. ..... 362/260
5,876,249 A * 3/1999 Kim ..... 439/619
6,039,597 A * 3/2000 Getselis et al. ..... 439/441
6,099,336 A * 8/2000 Evanisko ..... 439/231

* cited by examiner

*Primary Examiner*—Chandrika Prasad
(74) *Attorney, Agent, or Firm*—Herbert Dubno; Andrew Wilford

(57) ABSTRACT

A lampholder has a socket having an inner end and formed with an outwardly open lamp seat defining an axis and adapted to fit with a base of a high-voltage lamp and with a pair of inwardly open blind contact holes. A base fitted against the inner end and formed at the contact holes with respective contact seats has a floor formed in line with each contact hole with an axially throughgoing aperture. Respective contacts in the contact seats are each formed with an abutment arm extending along a wall of the respective contact hole and a spring arm extending into the respective contact hole and elastically deformable from a rest position closely juxtaposed with the respective abutment arm to a holding position spaced therefrom. Thus a conductor pushed through one of the apertures into the respective contact hole will wedge between the contact arms.

12 Claims, 2 Drawing Sheets

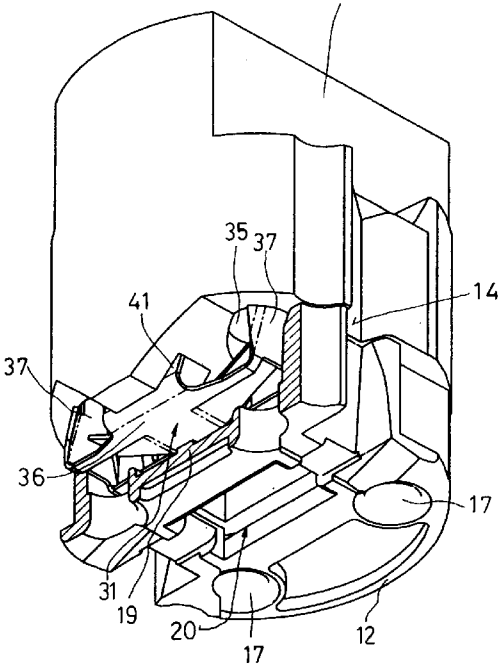
FIG.5
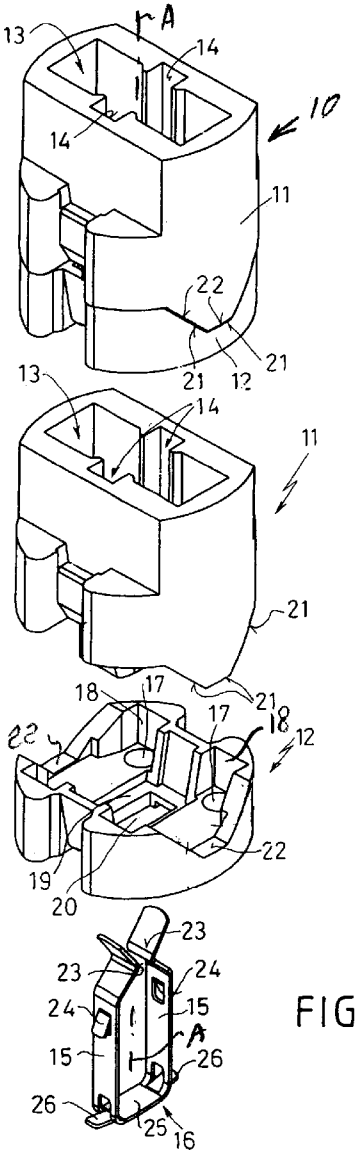
FIG.1
FIG.2
FIG.3
FIG.4

HIGH-VOLTAGE LAMPHOLDER WITH QUICK-CONNECT CONTACTS

FIELD OF THE INVENTION

The present invention relates to lampholder for a high-voltage lamp. More particularly this invention concerns such a lampholder with quick-connect contacts.

BACKGROUND OF THE INVENTION

A standard lampholder, for instance for a high-voltage metal-halide lamp, has a ceramic or porcelain socket having an inner end and forming an outwardly open lamp seat defining an axis and adapted to fit with a base of a high-voltage lamp, a base fittable against the inner end, and a contacts in the base intended to make the connection between supply wires and terminals on the lamp, A standard high-voltage halogen lamp with a G9 base is held in such a lampholder. A U-shaped retaining spring secured to the socket holds the lamp physically in place in the lamp seat while the contacts engage the terminals on the lamp. To this end the contacts are formed as cages which are difficult to manufacture, requiring several stamping and bending steps to make them of a simple rectangular flat metal blank, the contacts being cut and bent from the ends of the blank. The contacts are held in place on the ceramic or porcelain socket by a base that is made of a temperature-resistant plastic, e.g. a liquid-crystal polymer.

Since the lamp gets very hot in use and this heat is transmitted to the contacts, they must be held in the socket part of the lampholder. This is a problem in that ceramic and porcelain are hard to shape to very exact tolerances, so creating accurately shaped and dimensioned seats for the contacts is extremely difficult, resulting in many rejects and increased production costs. Furthermore the assembly process, normally entailing riveting the base to the socket, is fairly complex and difficult, again adding to the holder's production costs.

OBJECTS OF THE INVENTION

It is therefore an object of the present invention to provide an improved holder for a high-voltage lamp.

Another object is the provision of such an improved holder for a high-voltage lamp which overcomes the above-given disadvantages, that is which is of simple and durable construction and which is particularly easy to assemble and, if necessary, disassemble.

SUMMARY OF THE INVENTION

A lampholder has according to the invention a socket having an inner end and formed with an outwardly open lamp seat defining an axis and adapted to fit with a base of a high-voltage lamp and with a pair of inwardly open blind contact holes. A base fitted against the inner end and formed at the contact holes with respective contact seats has a floor formed in line with each contact hole with an axially throughgoing aperture. Respective contacts in the contact seats are each formed with an abutment arm extending along a wall of the respective contact hole and a spring arm extending into the respective contact hole and elastically deformable from a rest position closely juxtaposed with the respective abutment arm to a holding position spaced therefrom so that a conductor pushed axially forward through one of the apertures into the respective contact hole will wedge between the respective contact arms.

Thus this lampholder can be back wired with ease, simply by poking a stripped wire end into the contact hole in the back. The electrical connection thus made will be sound and physically strong, resisting withdrawal of the wire with considerable force. The fact that the contact holes are blind ensures that conductors poked into them cannot interfere with other functions of the lampholder and guarantees proper hookup.

According to the invention each of the contacts further has a bight portion lying against the socket and having opposite ends from each of which extends a respective one of the abutment arms and a respective one of the spring arms. Each bight is substantially planar and the arms are bent outward from the bight. The spring arms are bent outward from a point lying between where the respective abutments arms are bent from and the axis. Thus each contact is a simple piece that can be bent into its final shape in the same stamping operation that cuts it from a sheet blank, typically of copper-clad steel. It can be made easily to relatively close tolerances so that, even if the contact holes are less accurately dimensioned, the finished assembly will go together easily and work perfectly.

The socket is formed adjacent each contact hole with an angled face against which the respective spring arm is elastically deformable in the respective holding position. This prevents the spring arm from being bent too far so that it does not plastically deform.

In the rest position each spring arm bears radially outward on the respective abutment arm. Thus even a small-gauge conductor can be solidly gripped.

To contact a terminal of a lamp in the lamp seat each contact is further formed with a lamp-contact arm projecting axially into the lamp seat. This integral arm directly contacts the lamp terminal to conduct electricity between it and the wire in the contact hole.

The base according to the invention is formed with a pair of contact seats snugly holding the respective contacts. In addition the contacts are at least partially sandwiched between the socket and the base so that no extra parts, for instance rivets, are needed to secure the contacts in place.

The base in accordance with the invention is formed of a plastic highly resistant to heat, such as polyphenyl sulfide or liquid-crystal polymer. The socket is formed or ceramic or porcelain.

The base according to the invention is formed with an axially throughgoing central hole and the lampholder further has a clip formed with a bight engaged in the central hole, a pair of arms extending from respective ends of the bight outward into the socket, outer tabs on the arms bearing axially inward on the socket, and inner tabs at the bight bearing axially outward on the floor of the base so that the clip holds the socket and base together. The inner tabs are elastically deformable and press the socket axially outward against the outer tabs. Thus the clip holds the entire lampholder together, eliminating the need for a separate fastener, and even allows the assembly to be taken apart without damage if that becomes necessary at a later date.

BRIEF DESCRIPTION OF THE DRAWING

The above and other objects, features, and advantages will become more readily apparent from the following description, reference being made to the accompanying drawing in which:

FIG. 1 is a perspective view of the lampholder according to the invention;

FIGS. 2, 3, and 4 are perspective views of the socket, base, and clip of the lampholder of this invention;

FIG. 5 is a large-scale perspective view partly in axial section through the lampholder in accordance with the invention;

SPECIFIC DESCRIPTION

Figure 7:
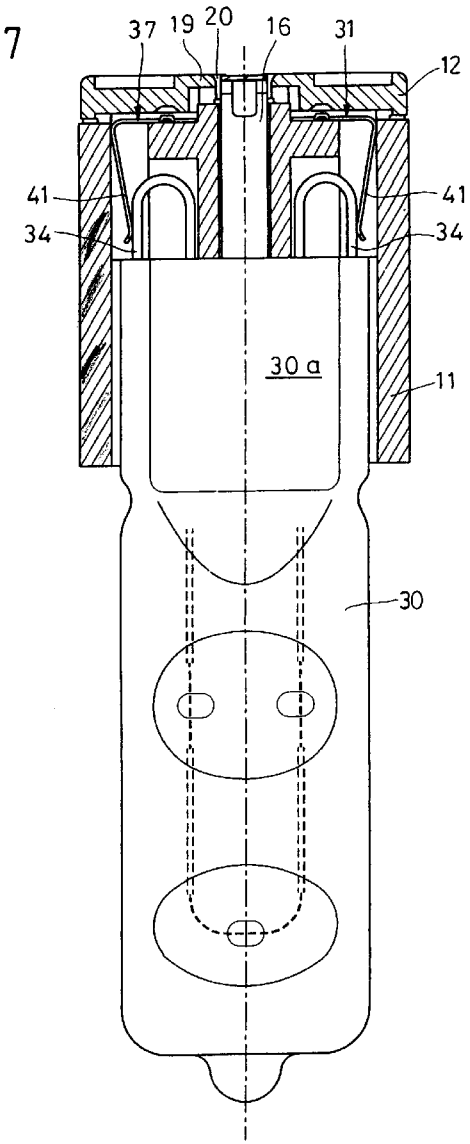
FIG. 7 is a large-scale axial section through the lampholder holding a lamp.
Figure 6:
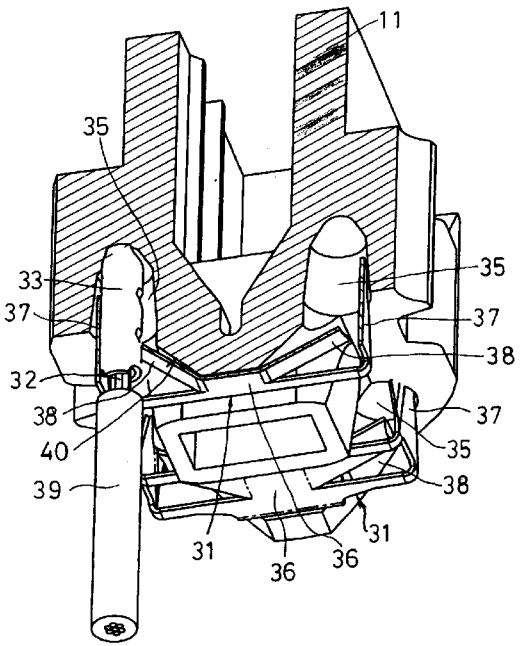
FIG. 6 is a large-scale axial section in perspective view through the socket and contacts of the lampholder.

As seen in FIGS. 1 through 4 a lampholder 10 according to the invention basically comprises a socket 11 made of porcelain or ceramic, a base 12 molded of a plastic such as polyphenyl sulfide or liquid crystal polymer stable at high temperatures, a clip 16 normally made of copper-clad sheet steel, and similarly constructed contacts 31 (FIGS. 5 through 7 only). These parts 11, 12, and 16 all are generally centered on and extend along an axis A while the contacts 31 flank the axis A.

The socket 11 is formed with an axially throughgoing and stepped rectangular-section seat 13 having an outer end adapted here to fit with a standard G9 base 30*a* of a lamp 30 (FIG. 7 only). Opposite faces of the seat 13 are formed with diametrally opposite and confronting rectangular-section grooves 14. An inner end of the socket 11 is formed with a pair of blunt axially inwardly projecting V-shaped projections or lugs 21 that symmetrically flank the axis A.

The base 12 is essentially annular and formed with a pair of notches 22 complementary to and normally snugly receiving the lugs 21. A floor 19 of the base 12 has a central rectangular throughgoing hole or passage 20. A bottom face of the socket 11 lying in a plane perpendicular to the axis A is formed with a pair of diametrally oppositely extending grooves or seats symmetrically flanking the hole 20. Throughgoing apertures 17 are provided to allow conductive sleeves 33 on and forming part of conductors 32 (FIG. 6 only) of wires 39 to pass through the floor 19 and fit with the contacts 31 that sit in the seats flanking the hole 20. The apertures 17 open axially outward to allow the contacts 31 to connect with terminal pins 34 (FIG. 7) on the lamp 30 fitted to the seat 13.

The clip 16 has a pair of axially extending parallel arms 15 interconnected by a transverse base 25. This base 25 is positioned in the hole 20 extending perpendicular to the axis A and the arms 15 extend outward in the grooves 14, with bent-in outer ends 23 of the arms 15 serving to grip the base 30*a* of the lamp 30 in the seat 13. To hold the two parts 11 and 12 together, outer tabs 24 punched out of the arms 15 and extending away from each other axially inwardly engage shoulders formed in the grooves 14. In addition inner tabs 26 punched out of the arms 15 where they join the base 25 are fitted to seat grooves and bear outward on the floor 19 of the base 12. The spacing between the outer faces of the inner tabs 26 and the inner ends of the outer tabs 24 is, in an unstressed condition of the clip 16, slightly less than the distance between the floors of the grooves and the shoulders so that the clip 16 is under slight axial tension to hold the two parts 11 and 12 tightly together. The planar bight part 25 of the clip 16 substantially fills and closes the hole 20 in the floor 19.

The socket 11 is formed in line with each of the apertures 17 in the base 12 with an inwardly open blind bore or hole 35. Each contact 31 has a bight portion 36 lying in a plane perpendicular to the axis A flatly on an inner face of the socket 11, a spring arm 38 that projects at an acute angle outward into the respective blind bore 35, and another abutment arm 37 that projects axially upward into the respective bore 35 from the very end of the bight 36. The socket 11 is formed between each bore 35 and this bottom face with an angled surface 40 that prevents overbending of the arms 38. Normally each arm 38 bears on or is very closely juxtaposed with the respective arm 37. Furthermore, each contact 31 is formed with another arm 41 (FIG. 7 only) that projects up in the seat 13 to engage the respective terminal 34 of the bulb 30.

The lampholder 10 according to the invention is assembled by first, as is standard, fitting the contacts 31 to the seats 18 and connecting them, if necessary, to lead wires 39 simply by pushing the conductors 32 with their sleeves 33 into the apertures 17. This action cams each of the arms 38 back so that it rides along one side of the respective conductor sleeve 33 and pushes the other side of it against the other arm 37, forming a good electrical connection therewith. The angled position of the arm 38, directed outward, forms a solid one-way connection in that, once a conductor end 32, is pushed into the respective hole 35, it cannot be pulled back out unless the arm 38 is cammed back with a separate tool.

Then the socket 11 is fitted to the base 12 with the lugs 21 in the notches 22. The clip 16 is then pushed into the hole 20 from the bottom until the outer tabs 24 snap in place on the shoulders and the inner tabs 26 come to bear on the floors of the seats. This completes the assembly. The lamp 30 can be pushed into the seat 13 so its end 30*a* is gripped between the arm ends 23 and its terminal pins 34 fit with the contacts 31.

The lampholder 10 can be taken apart once the lamp 30 is removed simply by prying inward the arms 15 of the clip to pull the outer tabs 24 off the shoulders 27. Then the clip 16 can be pulled axially inward out of the hole 20 to leave the lampholder 10 in five pieces, namely the socket 11, base 12, clip 16, and two contacts 31.

We claim:

1. A lampholder comprising:

a socket having an inner end and formed with an outwardly open lamp seat defining an axis and adapted to fit with a base of a high-voltage lamp, and a pair of inwardly open blind contact holes;

a base fitted against the inner end, formed at the contact holes with respective contact seats, and having a floor formed in line with each contact hole with an axially throughgoing aperture; and respective contacts in the contact seats and each formed with an abutment arm extending along a wall of the respective contact hole and a spring arm extending into the respective contact hole and elastically deformable from a rest position closely juxtaposed with the respective abutment arm to a holding position spaced therefrom, whereby a conductor pushed axially forward through one of the apertures into the respective contact hole will wedge between the respective spring arm and abutment arm.

2. The lampholder defined in claim 1 wherein each of the contacts further has a bight portion lying against the socket and having opposite ends from each of which extends a respective one of the abutment arms and a respective one of the spring arms.

3. The lampholder defined in claim 2 wherein each bight is substantially planar and the arms are bent outward from the bight, the spring arms being bent outward from a point lying between where the respective abutments arms are bent from and the axis.

4. The lampholder defined in claim 3 wherein the socket is formed adjacent each contact hole with an angled face against which the respective spring arm is elastically deformable in the respective holding position.

5. The lampholder defined in claim 1 wherein in the rest position each spring arm bears radially outward on the respective abutment arm.

6. The lampholder defined in claim 1 wherein each contact is further formed with a lamp-contact arm projecting axially into the lamp seat and engageable with a terminal of a lamp in the lamp seat.

7. The lampholder defined in claim 1 wherein the base is formed with a pair of contact seats snugly holding the respective contacts.

8. The lampholder defined in claim 1 wherein the contacts are at least partially sandwiched between the socket and the base.

9. The lampholder defined in claim 1 wherein the base is formed of a plastic material highly resistant to heat.

10. The lampholder defined in claim 1 wherein the socket is formed or of ceramic or porcelain.

11. The lampholder defined in claim 1 wherein the base is formed with an axially throughgoing central hole and the lampholder further comprises a clip formed with a bight engaged in the central hole, a pair of arms extending from respective ends of the bight outward into the socket, outer tabs on the arms bearing axially inward on the socket, and inner tabs at the bight bearing axially outward on the floor of the base, whereby the clip holds the socket and base together.

12. The lampholder defined in claim 11 wherein the inner tabs are elastically deformable and press the socket axially outward against the outer tabs.

* * * * *